US006644257B2

(12) United States Patent
Kunz et al.

(10) Patent No.: US 6,644,257 B2
(45) Date of Patent: Nov. 11, 2003

(54) METHOD FOR ADJUSTING AN ACTUATOR

(75) Inventors: Franz Kunz, Altmannstein (DE); Wolfgang Stowasser, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/257,461

(22) PCT Filed: Mar. 30, 2001

(86) PCT No.: PCT/DE01/01222

§ 371 (c)(1),
(2), (4) Date: Oct. 11, 2002

(87) PCT Pub. No.: WO01/79662

PCT Pub. Date: Oct. 25, 2001

(65) Prior Publication Data

US 2003/0106513 A1 Jun. 12, 2003

(30) Foreign Application Priority Data

Apr. 14, 2000 (DE) ..... 100 18 659

(51) Int. Cl.[7] ..... F01L 1/34

(52) U.S. Cl. ..... 123/90.17; 123/90.15; 123/90.11; 251/129.05

(58) Field of Search ..... 123/90.17, 90.11–90.18, 123/90.31; 332/109; 251/129.05; 91/459–461; 363/26; 388/804, 811, 819; 137/14, 487.5

(56) References Cited

U.S. PATENT DOCUMENTS 4,909,194 A 3/1990 Bauer
5,152,261 A 10/1992 Butterfield et al.
5,172,659 A 12/1992 Butterfield et al.
5,363,817 A * 11/1994 Ikeda et al. ..... 123/90.15
5,562,071 A * 10/1996 Urushihata et al. ..... 123/90.15
6,006,708 A * 12/1999 Ken et al. ..... 123/90.17

FOREIGN PATENT DOCUMENTS

| | | |
|---|---|---|
| DE | 3140301 | 4/1983 |
| DE | 3200457 | 7/1983 |
| DE | 350584 | 8/1985 |
| DE | 4408425 | 12/1994 |
| DE | 4340612 | 6/1995 |
| DE | 19601232 | 7/1997 |
| DE | 1037999 | 8/1997 |
| DE | 19643297 | 3/1998 |
| EP | 0518528 | 12/1992 |

* cited by examiner

*Primary Examiner*—Thomas Denion
*Assistant Examiner*—Kyle Riddle
(74) *Attorney, Agent, or Firm*—Mayer Brown Rowe & Maw LLP

(57) ABSTRACT

An actuator which is displaced by a force in one end position and is displaced into the other end position by an adjusting device that is controlled using a pulse duration modulated signal. If a quasi-stationary condition is identified, in which despite repeated control intervention the actual position of the actuator lies outside a targeted range around the desired position, the retaining pulse duty factor which is used by the adjusting device to main the actuator in one position is modified based on the distance from the desired position. If drift is identified, the drift behavior is determined and the retaining pulse duty factor is modified according to said drift behavior.

18 Claims, 4 Drawing Sheets

METHOD FOR ADJUSTING AN ACTUATOR

This application is made pursuant to 35 U.S.C. §371 of international application number PCT/DE01/01222, filed Mar. 30, 2001 with a priority date of Apr. 14, 2000.

FIELD OF THE INVENTION

The invention relates a method for adjusting an actuator which can move between two end positions, which is displaced into one end position and which can be moved to the other end position by means of an adjusting unit.

BACKGROUND OF THE INVENTION

Actuators of the type in question here, which are displaced into one end position and can be moved into the other end position by means of an adjusting unit, must therefore be held in a desired position by actively activating the adjusting unit. From a held position, it is possible either to bring about adjustment into the one end position by suspending the activation of the adjusting unit, or to bring about adjustment into the other end position by increased activation of the adjusting unit. A convenient way of activating such an adjusting unit, which may, for example, operate electromagnetically, is actuation with a pulse-width-modulated signal. Depending on the pulse duty factor of the pulse-width-modulation, adjustment is carried out into one end position or the other end position. If the actuator is to be held in one position, the adjusting unit must be actuated with a retaining pulse duty factor.

The actuators which are described are preferably used in devices for camshaft phase adjustment in internal combustion engines. Such a camshaft phase adjuster is described, for example, in DE 43 40 614 C2. It is a typical example of an actuator which is influenced by an adjusting unit and in which dead times and delayed response require limitation of the maximum achievable adjustment speed and consequently corresponding parametrization of the associated adjuster.

Owing to these dead, times and the delayed response, it is not possible to equip the adjuster which adjusts the actual position of the actuator with an integral component as otherwise an unstable system would be produced. Instead, a certain maximum control error, below which the adjuster is not active, is permitted.

However, this procedure leads in such cases to difficulties in which the actual position of the actuator cannot be measured continuously but rather only sampling is possible. There are then cases in which, despite repeated adjusting intervention, the desired position is not reached but there is instead a quasi-steady or drifting state of the actuator in which the actuator exhibits a constant control error or a continuous movement to an end position.

Accordingly, there is a need, for a method of adjusting an actuator of the type described, with which precise adjustment to a desired position can be reached without quasi-steady or drifting states occurring.

Other needs will become apparent upon a further reading of the following detailed description taken in conjunction with the drawings.

SUMMARY OF THE INVENTION

The invention is based on the idea that the retaining pulse duty factor is, of course, the same for all the operating states of the actuator only in the rarest of cases. Although an actuator can be configured in such a way that the retaining pulse duty factor is the same for all the actual positions of the actuator, this cannot be achieved for all operating conditions, for example temperatures, supply voltages, hydraulic pressures or the like. If the retaining pulse duty factor does not have precisely the value which is necessary to keep the actuator in an actual position, it will move toward an end position. A faulty retaining pulse duty factor is thus the cause of a quasi-steady or drifting state. A quasi-steady state is found if, despite repeated adjusting intervention, a minimum control error is continuously exceeded. The retaining pulse duty factor is then changed until the control error drops below a threshold value.

In the case of the drifting state of the actuator, the drift behavior is determined and the retaining pulse duty factor is correspondingly corrected until the desired position is maintained precisely within a desired framework.

The difference between a quasi-steady and drifting state is caused by the fault in the retaining pulse duty factor. When there is a relatively large fault in the retaining pulse duty factor, a quasi-steady state will be established. Between the times of the sampling measurement of the actual position, the actuator drifts out of the acceptable control error so quickly that a constant control error is measured despite repeated control interventions. On the other hand, in the drifting state, the fault of the retaining pulse duty factor becomes relatively small. Here, the movement of the actuator out of the desired position takes place so slowly that one or more measurements exhibit an actual position within the acceptable control error. This makes it possible to determine the drift behavior, and calculate precisely the necessary correction of the retaining pulse duty factor from it.

As the retaining pulse duty factor may need to be corrected not only as a result of operating states of the actuator, but it may also need to be changed due to a defect in the actuator, a defect in the actuator is detected if the change in the retaining pulse duty factor appears necessary beyond a specific pulse width modulation. The actuator is also defective if correction of the retaining pulse duty factor is repeatedly necessary over a time period, that is to say no fixed retaining pulse duty factor can be found during the control over a relatively long time period during which the acceptable control error is maintained.

Owing to the dead times and the delayed response behavior of the actuator, it would of course be desirable to configure the adjuster to be as immune to oscillation as possible. On the other hand, in many applications, for example in the aforementioned camshaft phase adjusters, rapid re-adjustment into a new desired position is required. These, in themselves, contradictory objectives can be achieved in one preferred development by virtue of the fact that large jumps in the desired position can be achieved by pilot control and the adjuster is active only in a narrow range around the respective desired position. Here, the adjuster can be permitted only a certain maximum change of the pulse width modulation, which has positive effects on the stability. This maximum change is preferably dependent on the adjustment to be brought about in the actual position, which leads to the actual position being adjusted in a non-oscillating way to the, desired position, even when there are relatively long dead times.

In an actuator which is embodied as a camshaft phase adjuster, the sampling of the position of the camshaft, and thus the determination of the position of the actuator, generally takes place once or twice per revolution of the camshafts, in that a semicircular disk which is attached to the camshaft is sensed. The selection of the retaining pulse duty factor can be given a two-stage configuration for such a camshaft phase adjuster. On the one hand, a basic value for the retaining pulse duty factor is obtained from a basic characteristic diagram which takes into account operating parameters of the internal combustion engine, for example operating temperature, oil pressure, battery voltage or the like. On the other hand, the aforementioned correction of the retaining pulse duty factor can be obtained from an adaptation characteristic diagram which covers the constant control error or one or more parameters which characterize the drift behavior. Advantageous refinements of the invention are the subject matter of the subclaims.

These and other features and advantages of the invention will be apparent upon consideration of the following detailed description of the preferred embodiment of the invention, taken in conjunction with the appended drawings.

DETAILED DESCRIPTION OF THE INVENTION

Figure 1:
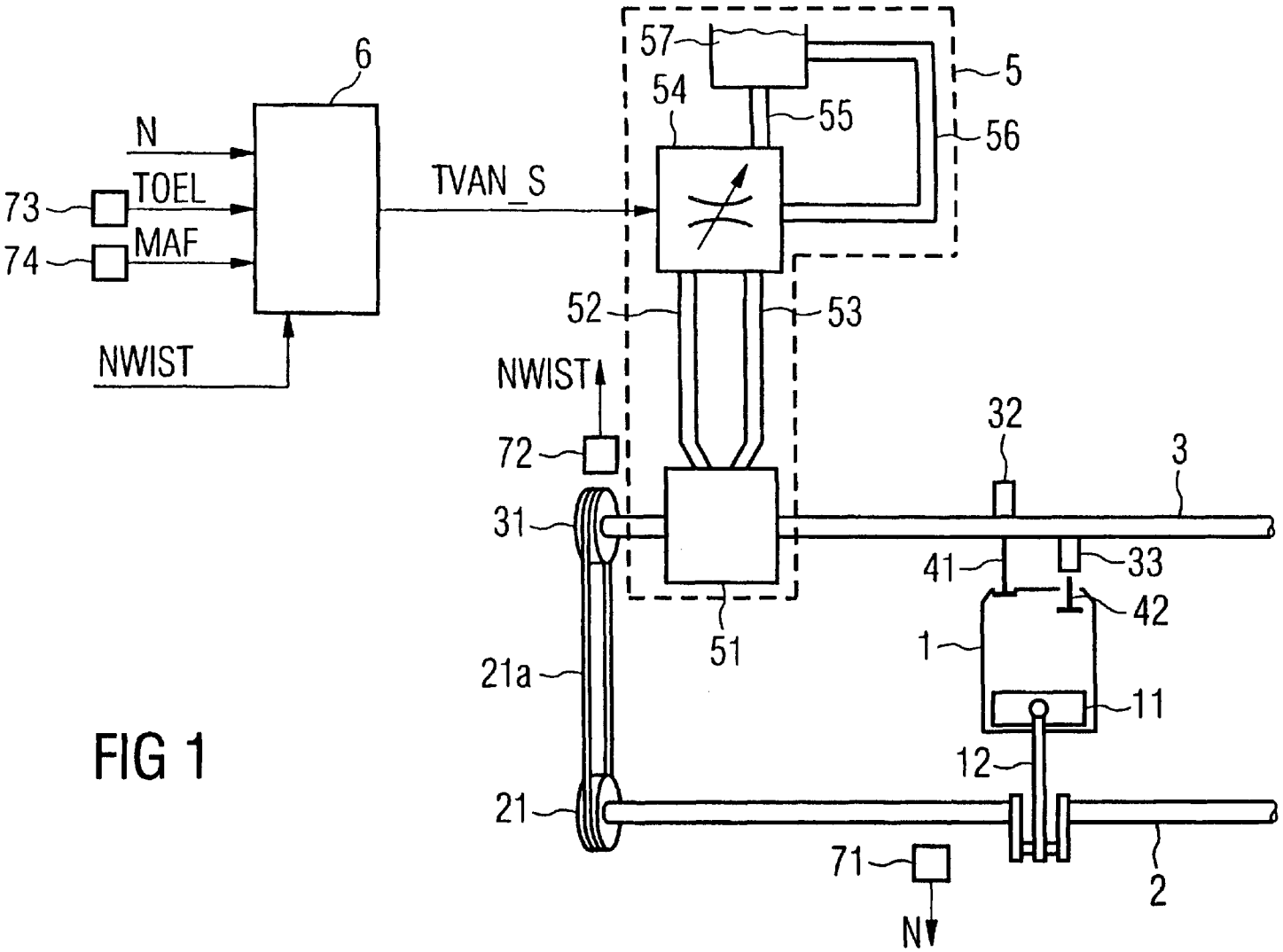
FIG. 1 shows a schematic illustration of an internal combustion engine with camshaft phase adjustment.

While the present invention is capable of embodiment in various forms, there is shown in the drawings and will be hereinafter described a presently preferred embodiment with the understanding that the present disclosure is to be considered as an exemplification of the invention, and is not intended to limit the invention to the specific embodiment described and illustrated.

In the figures, elements with identical design and function are provided with the same reference symbols.

An internal combustion engine which is shown schematically in FIG. 1 comprises a cylinder 1 with a piston 11 and a connecting rod 12. In the schematic drawing in FIG. 1, only one cylinder is illustrated, but of course an internal combustion engine is generally a multicylinder internal combustion engine. The connecting rod 12 is connected to a piston 11 and a crankshaft 2. A first gearwheel 21 is seated on the crankshaft 2 and is coupled via a chain 21*a* to a second gearwheel 31 which drives a camshaft 3. The camshaft 3 has cams 32, 33 which activate the charge cycle valves 41, 42.

In order to adjust the position or phase of the camshaft 3 in comparison with the crankshaft 2, an actuator, 5 is provided. It has a mechanical adjusting part 51 which is supplied by an electromagnetically activated two/three-way valve 54 via hydraulic lines 52, 53. The valve 54 is connected to an oil reservoir via a high pressure hydraulic line 55 and a low pressure hydraulic line 56, and an oil pump (not illustrated) generates the pressure in the high pressure hydraulic line 55.

A control unit 6 actuates the valve 54 by means of an actuation signal TVAN_S. The control unit 6 predefines the actuation signal TVAN_S here as a function of the values of various sensors 71 to 74. These are sensors for measuring the rotation speed N, the crankshaft angle of the crankshaft 2, the camshaft position NWIST, the air mass MAF sucked in by the internal combustion engine and the temperature TOEL of the oil which drives the adjusting part 51. Of course, this sensor equipment is to be understood only by way of example.

Figure 2:
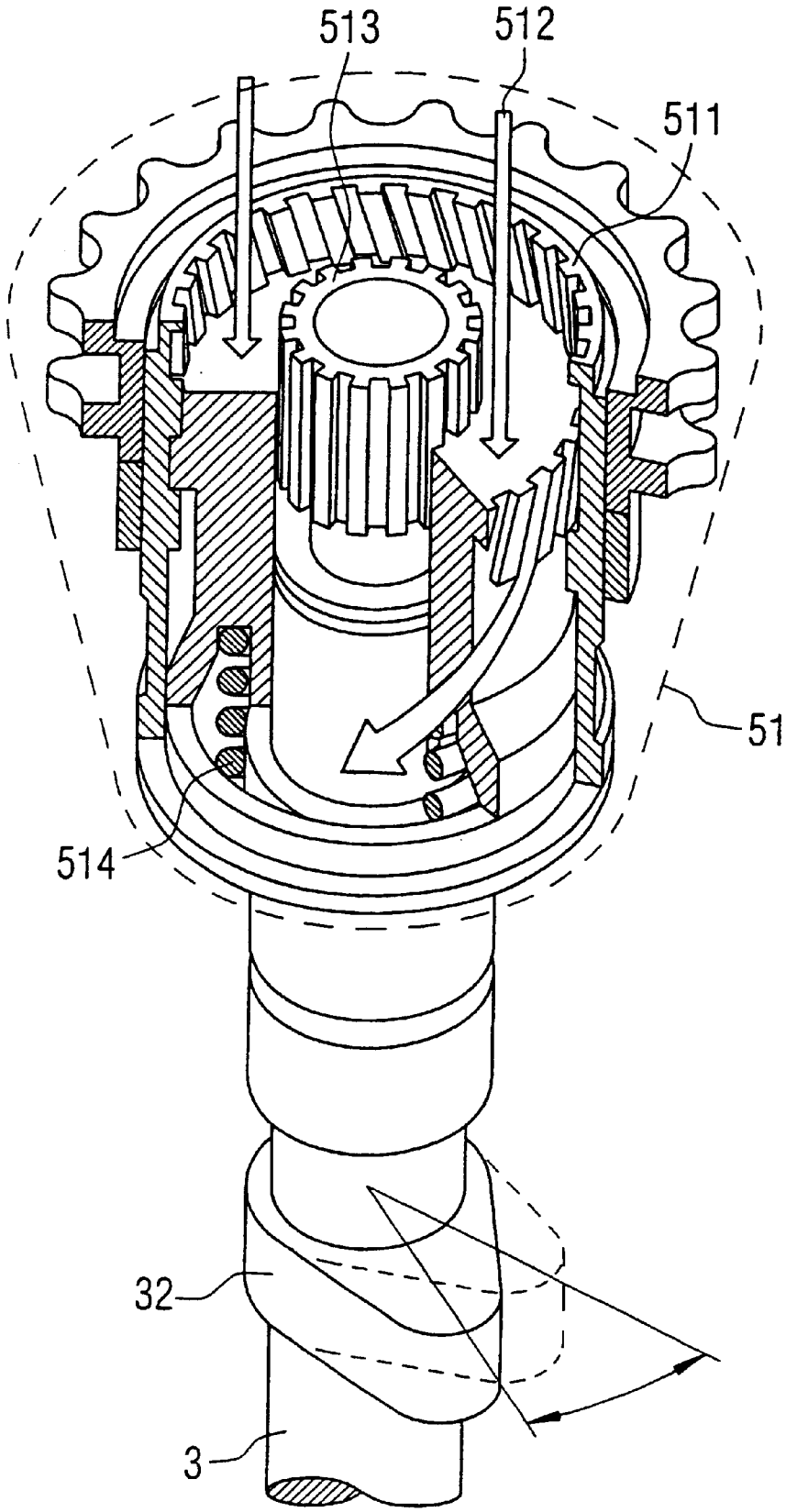
FIG. 2 shows a camshaft with a cut-open mechanical adjusting part.

FIG. 2 shows the camshaft 3 with the mechanical adjusting part 51 as a partial sectional view. The mechanical adjusting part 51 is driven by the second gearwheel 31 in which a third gearwheel 511 is seated in a positively locking fashion. This third gearwheel 511 has an internal beveled toothing which engages in an assigned external beveled toothing of a crown gear 512 which is seated in the third gearwheel 511. This crown gear has a drilled hole with straight toothing which engages in a corresponding toothing of a fourth gearwheel 513. This ensures that, irrespective of the axial position of the gearwheel 512, the fourth gearwheel 513 which is mounted on the camshaft 3 does not change its axial position, although the crown gear 512 is connected fixed in terms of rotation to the fourth gearwheel 513.

Depending on the oil pressure in the hydraulic lines 52, 53, the crown gear 512 is then displaced axially. with respect to the camshaft. Brought about by the engagement of the external beveled toothing of the, crown gear 512 and of the internal beveled toothing of the third gearwheel 511 one in the other, the camshaft 3 rotates with respect to the third gearwheel 511 which is connected fixed in terms of rotation to the second gearwheel 31.

A spring 514 displaces the crown gear 512 away from the. camshaft 3, and thus adjusts the phase of the camshaft 3 toward an end position. By means of the oil pressure in the hydraulic lines 52, 53 it is possible to bring about an adjustment, indicated schematically by dashed lines in FIG. 2, of the phase of the cam 32 with respect to the second gearwheel 31 which drives the camshaft 3.

The actuating device 5 thus brings about a phase adjustment of the camshaft 3 in relation to the crankshaft 2. The phase can be adjusted continuously within a predefined range. If both the camshaft 3, which is used to activate the inlet charge cycle valves, and a camshaft for activating the outlet charge cycle valves are correspondingly provided with an actuator 5, it is possible to vary the start of the stroke and the end of the stroke of the charge cycle valves which are predefined by means of the shape of the cam.

The method of operation of the valve 54 is relevant to understanding the invention only insofar as the energization of the electromagnet 57 sets the pressure electromagnet 57 is not energized, no pressure acts on the crown gear 512, for which reason there is no force opposing the spring 514, and the crown gear 512 is moved into its axial end position, away from the camshaft 3. This corresponds to an end position of the camshaft phase adjustment range. If the electromagnet 57 is energized to a maximum extent, the other end position of the camshaft phase adjusting range is reached. For the purpose of energization, the electromagnet 57 is actuated with the actuation signal TVAN_S in a pulse-width-modulated fashion.

In order to hold the actuator 5 in a specific position, the actuation signal TVAN_S is pulse-width-modulated with a retaining pulse duty factor. The retaining pulse duty factor is selected here in such a way that the pressure in the hydraulic line 52 which acts on the crown gear 512 precisely compensates the force, of the spring 514 in a desired position of the crown gear 512. The spring 514 is configured in such a way that the force exerted by it is identical for each position of the crown gear 512. The retaining pulse duty factor is then the same for all the camshaft phase positions. The retaining pulse duty factor is, for example, in the vicinity of 50%. Of course, the retaining pulse duty factor can also depend on the camshaft phase adjustment, but this is not assumed in what follows.

In order to move the camshaft, phase adjustment means from one specific position to the other, when there is an adjustment which signifies an increase in pressure, the electromagnet 57 is energized to a greater extent. Although, depending on the design, a greater degree of energization would also result in a reduction in the pressure in the hydraulic line 52, it is assumed in what follows that a greater degree of energization of the electromagnet 57 brings about an increase in the pressure in the line 52.

Figure 3:
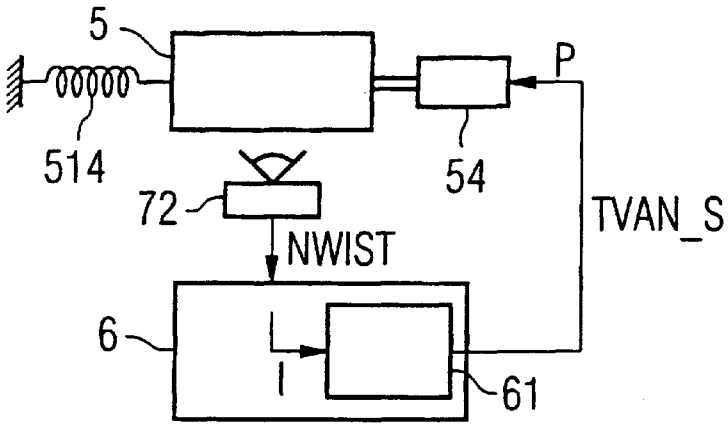
FIG. 3 shows a block circuit diagram of the control circuit for camshaft phase adjustment.

FIG. 3 shows, as a block circuit diagram, the control circuit for camshaft phase adjustment. The control unit 6 has an adjuster 61. It continues to measure the position of the camshaft 3 by means of the sensor 72 by sensing a semicircular disk which is mounted on the second gearwheel 31. The signal NWIST of the sensor 73 is converted, in the control unit 6, into an actual position I of the actuator 5 as ultimately only the latter is of interest for the adjuster 61. The adjuster 61 outputs the actuation signal TVAN_S to the solenoid valve 54. The actuation signal is pulse-width modulated with a factor P. The solenoid valve 54 brings about an adjustment of the actuator 5 counter to the force of the spring 514.

Figure 4:
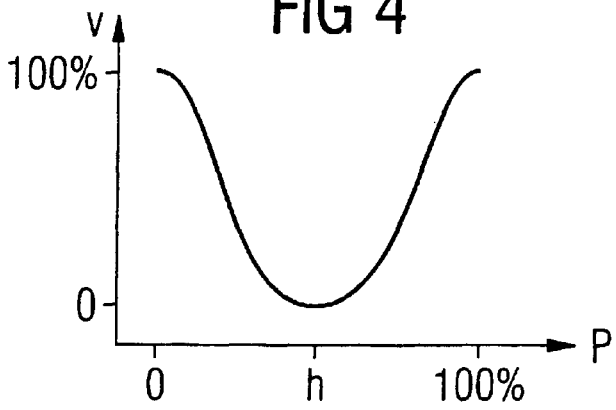
FIG. 4 shows the relationship between the pulse width modulation factor and adjustment speed of the actuator.
Figure 5:
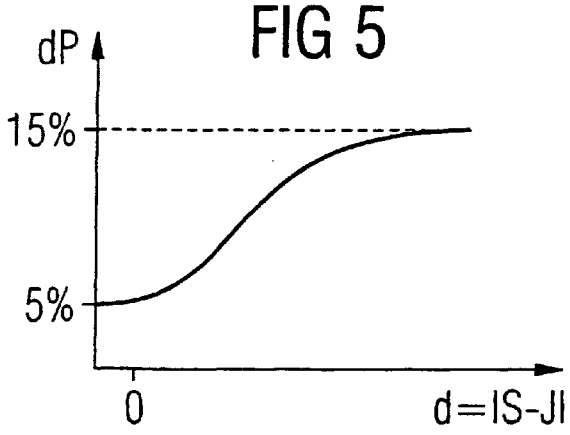
FIG. 5 shows, the variation range of the pulse width modulation which is accessible to the adjuster, as a function of the control error.

As the solenoid valve 54 controls the hydraulic flow to the mechanical adjusting part 51, the adjusting speed which is brought about here is not linearly dependent on the factor P of the pulse-width modulation. The relationship is plotted in FIG. 4. Given a pulse-width modulation factor P of zero, a maximum adjusting speed v of 100% is reached, and in this case the adjustment is carried out exclusively by means of the spring 514. When there is a maximum pulse width modulation factor P of 100%, i.e. when there is continuous energization of the solenoid valve 54, the adjustment to the other end position takes place at a maximum speed v. When there is a factor P of the pulse width modulation of h, the actuator 5 is held, for which reason this factor h is referred to as retaining pulse duty factor. Small deviations in the retaining pulse duty factor h lead to a relatively small adjusting speed. The shape of the curve in FIG. 4 makes it possible to configure the adjuster 61 to be stable by allowing it only a restricted range of the factor P of the pulse width modulation around the pulse duty factor h. This is represented in FIG. 5 in which the variation dP of the factor P which is permitted to the adjuster is plotted as a function of the control error d which results from the difference in absolute value between the desired position S and actual position I. When there is a control error d=0, the variation dP allowed to the adjuster is 5%. As the control error increases, it rises to a maximum value of, for example, 15%. This configuration of the adjuster 61 brings about a stable control behavior. In order, nevertheless, to be able to ensure a high adjusting speed, when there are large jumps in the desired position S, the adjuster 61 is supported by the control unit 6 by means of a prior control. For this purpose, the control unit 6 changes the factor P of the pulse width modulation of the actuation signal TVAN_S by a certain degree for a certain time period until the desired position jump to be carried out is achieved to a certain degree, for example 80%.

The remaining change in the desired position is then left to the adjuster 61, which reaches the new desired position, without oscillation on the basis of the configuration illustrated in FIG. 5.

In order to configure the adjuster 61 so as to be stable, in addition to the limitation of the variation dP which is described in FIG. 5, there is provision for the adjuster 61 to perform an adjusting intervention only when there are certain minimum control errors dmin, on which details will be given later.

The retaining pulse duty factor h must, as mentioned above, be selected such that the actuator 5 holds its actual position. For this purpose, the force of the spring 514 must be compensated by the pressure in the hydraulic line 52. In the case of an actuator 5 which is not displaced into the one end position by a spring 514 but rather by the activation forces of the cams 32, 33, these forces must be compensated.

The retaining pulse duty factor h depends on various operating variables. These are, on the one hand, the temperature and the pressure of the hydraulic fluid in the hydraulic lines 52, 53, 55 and 56. On the other hand, the battery voltage during the energization of the electromagnet 57 has an effect. The retaining pulse duty factor h is thus taken from a characteristic diagram as a function of these operating parameters. With the solenoid valve 54 described here it is approximately 50%. In contrast, when activation is not hydraulic but rather purely electromagnetic, it will differ greatly from this, being for example 4%.

Figure 6:
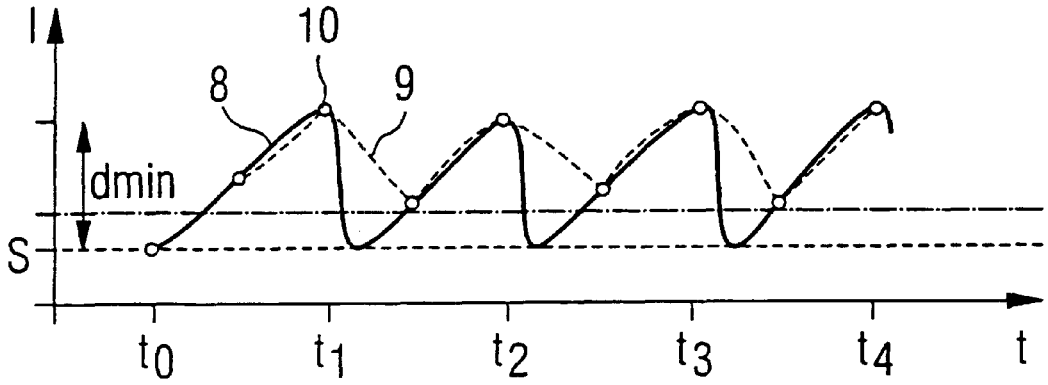
FIGS. 6 show time sequences of the actual position of to 8. the actuator.

When the retaining pulse duty factor h has been obtained from the characteristic diagram, it is still possible for a permanent control error d to be established, as is shown in FIG. 6. FIG. 6 shows the actual position I of the actuator, and thus of the camshaft phase, as a time sequence. The dashed line shows the desired position S. The dot-dashed line shows the acceptable control error, and curve 8 illustrates the actual position I of the actuator 5 which is sampled at the measurement point 10. As the sampling frequency depends on the rotational speed of the camshaft owing to the sampling of the semicircular wheel on the second gearwheel 31, the measurement points 10 in the case illustrated are too far apart from one another to represent the actual profile of the curve 8. Undersampling occurs, which does not fulfil the sampling theorem. As a result, the curve 9 which is illustrated with dashed lines appears as a virtual position of the actuator 5. The minimum control error, below which adjusting intervention must not be performed for reasons of stability, is entered as dmin.

In the case illustrated, the retaining pulse duty factor h is incorrect, for which reason the actuator 5 moves out of the desired position. At the time $t_0$ it will be assumed, for the sake of illustration, that the actual position I is the same as the desired position S. Owing to the incorrect retaining pulse duty factor h, the actuator moves out of the desired position S. It is only during the second measurement of the actual position at the time $t_1$ that the adjuster 61 determines that an adjusting intervention is necessary as the minimum control error dmin has been exceeded. For the adjusting intervention, the solenoid valve 54 is briefly energized with a factor P of the pulse width modulation which differs from the retaining pulse duty factor h. Although the actuator 5 is moved into the region of the acceptable control error, here even the desired position S, the acceptable control error has already been exceeded again by the next measurement point. It is only at the subsequent measurement point, at the time $t_2$, that the adjuster 61 has an opportunity for an adjusting intervention as it is only then that the minimum control error dmin is exceeded. The position of the measurement points 10 therefore results in beats in a quasi-steady state in which none of the measurement points 10 lies within the acceptable control error around the desired position S. The system does not leave this quasi-steady state outside the acceptable control error, although the adjuster performs adjusting interventions at the times $t_1$, $t_2$, $t_3$, $t_4$, etc., as the error of the retaining pulse duty factor h is so large that, by the next measurement, the actual position I already deviates significantly from the desired position S again, and the acceptable control error is exceeded.

Figure 7:
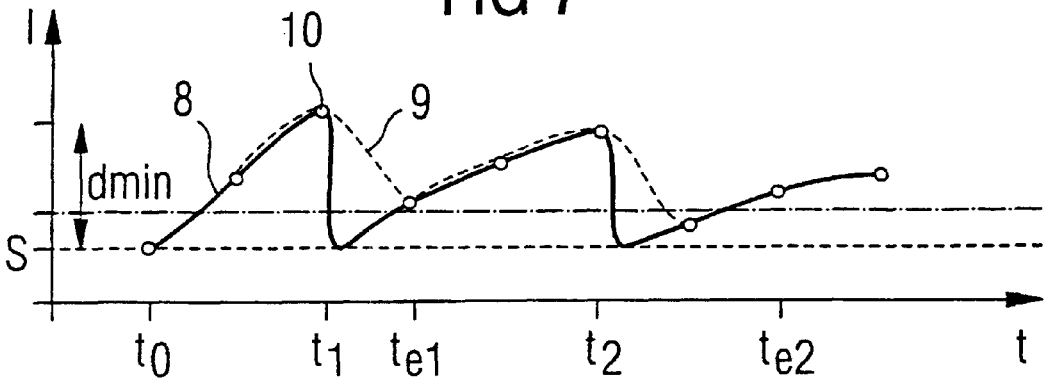

In order to avoid or leave this quasi-steady state, the retaining pulse duty factor h is then changed if the control unit 6 detects that, despite an adjuster intervention at the time $t_1$, the next measurement point lies outside the acceptable control error. This is illustrated in FIG. 7. Up to the first measurement point after the time $t_1$, the time sequence in FIG. 7 does not differ from the time sequence in FIG. 6. If the control unit determines, with the first measurement point after the control intervention at the time $t_1$, that the actual position I lies outside the acceptable control error S, the retaining pulse duty factor h is changed at the time $t_{e1}$, in this case reduced. The reduction in the retaining pulse duty factor h leads to a decrease in the drift with which the actual position I moves away from the desired position S. However, at the time $t_2$ the minimum control error dmin is exceeded, which leads to renewed adjusting intervention. Then, the retaining pulse duty factor h can be changed again with a further correction, as a result of which the actual position I moves away from the desired position S even more slowly. This further correction of the retaining pulse duty factor h takes place at the time $t_{e2}$ at which it becomes apparent that the acceptable control error is exceeded again. This is not the case with the first measurement after the time $t_2$, owing to the correction at the time $t_{e1}$ at which the retaining pulse duty factor h has already been more, satisfactorily approximated to the actual value, but rather only with the second measurement. Only after this measurement is a correction of the retaining pulse duty factor performed at the time $t_{e2}$.

With this second correction at the time $t_{e2}$, the error of the retaining pulse duty factor is so small that the drift of the retaining pulse duty factor is slowly toward the sampling rate of the measurement of the sensor 72 which leads to spacing apart of the measurement points 10. After an adjusting intervention which occurs whenever the minimum control error dmin is exceeded, there are always a number of measurement points 10 which lie within the acceptable control error. A quasi-steady state outside-this control error therefore no longer occurs.

Figure 8:
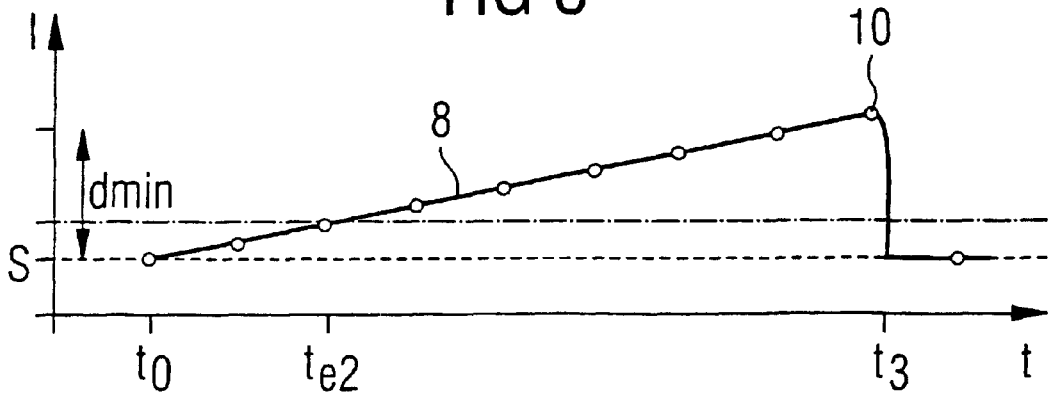

This state in which a slow drift is determined is illustrated in FIG. 8. It is then possible to determine the drift speed or the drift behavior of the actual position I precisely as a plurality of measurement points 10 lie within the acceptable control error. The curve 8 of FIG. 10 can be conceived of as a continuation of the curve 8 in FIG. 7 if it is considered starting from the time $t_{e2}$. The drift state of the actual position I illustrated in FIG. 8 can, however, also be present independently of the previous state of FIG. 7. It always occurs if the retaining pulse duty factor h is, relatively close to the target value but is nevertheless incorrectly too large or too small. As in this drift case, the measurement points 10 are close enough to one another to fulfil the sampling theorem approximately, the drift behavior can be determined from the position of the measurement points 10 and a correction of the retaining pulse duty factor can be determined directly therefrom as follows:

$$D=[I(t_3)-I(t_{e2})]/[(t_3-t_{e2})\cdot I(t_3)].$$

Here, I(t) is the actual position at the time t,$t_{e2}$ is the time at which the acceptable control error is exceeded, and $t_3$ is the time at which dmin is exceeded. The drift factor D which is given by this equation can be used directly from multiplicative correction of the retaining pulse duty factor h. It expresses the percentage increase in the drift illustrated in FIG. 8. It permits fine correction of the retaining pulse duty factor h in the cases in which the drift can be determined, i.e. if the drift is slow toward the sampling rate of the measurements of the sensor 72. The correction of the retaining pulse duty factor h which has been described with reference to FIGS. 6 and 8 can also be achieved by accessing a characteristic diagram in which the correction of the retaining pulse duty factor h is stored as a function of the error in the quasi-steady state in FIG. 6, or the drift behavior in the case of FIG. 8. This characteristic diagram makes it possible to dispense with the calculation of the drift factor D in the equation designated above. A time period can, for example, be input into this characteristic diagram. This may be the time period which passes between the start of the retaining mode with the retaining pulse duty factor h and the first time the minimum error dmin is reached or exceeded. The corresponding correction factor for the retaining pulse duty factor h can then be determined from this time by means of the characteristic diagram.

The foregoing description of a preferred embodiment of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined by the claims set forth below.

What is claimed is:

1. A method for adjusting an actuator which can move between two end positions, which is displaced into one end position and can be moved into the other end position by activating an adjusting unit, the method comprising:

sensing the actual position of the actuator;

adjusting the actuator to a desired position using a pulse-width-modulated actuation of the adjusting unit;

holding the actuator in the desired position by actuation using a retaining pulse duty factor and, only if a minimum adjustment of the actuator is necessary, an adjusting intervention using the retaining pulse duty factor of a deviating pulse width modulation; and correcting the retaining pulse duty factor if, despite repeated adjusting intervention, a deviation between the desired position and actual position is continuously measured, until the deviation drops below a threshold value.

2. The method as claimed in claim 1, wherein a defect in the actuator is detected if the correction of the retaining pulse duty factor is necessary beyond a specific pulse width modulation.

3. The method as claimed in claim 1, wherein a defect in the actuator is detected if the correction of the retaining pulse duty factor is necessary beyond a predetermined time period.

4. The method as claimed in claim 1, wherein a control intervention brings about only ascertain maximum change in the pulse width modulation.

5. The method as claimed in claim 4, wherein the maximum change in the pulse width modulation is dependent on the adjustment in the actual position which is to be brought about by the adjusting intervention.

6. The method as claimed in claim 4, wherein adjustments of the actual position which exceed a limiting value brought about in a controlled fashion, and in that after this control intervention the adjustment is continued to the desired position.

7. The method as claimed in 1, wherein said method is used for adjusting a camshaft phase adjuster of an internal combustion engine, and wherein the actual position of the camshaft phase adjuster takes place by sampling the position of the camshaft, at least one measurement being made per revolution of the camshaft.

8. The method as claimed in claim 1, wherein said method is used for adjusting a camshaft phase adjuster of an internal combustion engine, and wherein the retaining pulse duty factor is obtained from a basic characteristic diagram which covers operating parameters of the internal combustion engine, and wherein the correction of the retaining pulse duty factor is obtained from an adaptation characteristic diagram which covers the constant deviation between the desired position and actual position.

9. A method for adjusting an actuator which can move between two end positions, which is displaced into one end position and can be moved into the other end position by activating an adjusting unit, the method comprising:

sensing the actual position of the actuator;

adjusting the actuator to a desired position by means of pulse-width-modulated actuation of the adjusting unit;

holding the actuator in the desired position by actuation using a retaining pulse duty factor and, only if a minimum adjustment of the actuator is necessary, an adjusting intervention using the retaining pulse duty factor of a deviating pulse width modulation; and when there is a drift in the actual position between the repeated adjusting interventions, determining a drift absolute value from the maximum error between the actual position and desired position, determining a drift time, and obtaining the correction of the retaining pulse duty factor from the drift absolute value and the drift time.

10. The method as claimed in claim 9, wherein a defect in the actuator is detected if the correction of the retaining pulse duty factor is necessary beyond a specific pulse width modulation.

11. The method as claimed in claim 9, wherein a defect in the actuator is detected if the correction of the retaining pulse duty factor is necessary beyond a predetermined time period.

12. The method as claimed in claim 9, wherein a control intervention brings about only a certain maximum change in the pulse width modulation.

13. The method as claimed in claim 12, wherein the maximum change in the pulse width modulation is dependent on the adjustment in the actual position which is to be brought about by the adjusting intervention.

14. The method as claimed in claim 12, wherein adjustments of the actual position which exceed a limiting value brought about in a controlled fashion, and in that after this control intervention the adjustment is continued to the desired position.

15. The method as claimed in 9, wherein said method is used for adjusting a camshaft phase adjuster of an internal combustion engine, and wherein the actual position of the camshaft phase adjuster takes place by sampling the position of the camshaft, at least one measurement being made per revolution of the camshaft.

16. The method as claimed in claim 9, wherein said method is used for adjusting a camshaft phase adjuster of an internal combustion engine, and wherein the retaining pulse duty factor is obtained from a basic characteristic diagram which covers operating parameters of the internal combustion engine, and wherein the correction of the retaining pulse duty factor is obtained from an adaptation characteristic diagram which covers the constant deviation between the desired position and actual position.

17. A method for adjusting an actuator which is movable between two end positions, the method comprising:

sensing the position of the actuator;

adjusting the actuator to a desired position using an adjusting unit that is actuated with pulse width modulation;

holding the actuator in the desired position by actuation using a retaining pulse duty factor and, only if a minimum adjustment of the actuator is necessary, an adjusting intervention using the retaining pulse duty factor of a deviating pulse width modulation; and correcting the retaining pulse duty factor if, despite repeated adjusting intervention, a deviation between the desired position and actual position is continuously measured.

18. The method as claimed in claim 17, wherein a defect in the actuator is detected if the correction of the retaining pulse duty factor is necessary beyond a specific pulse width modulation, wherein a control intervention brings about only a certain maximum change in the pulse width modulation, and wherein the maximum change in the pulse width modulation is dependent on the adjustment in the actual position which is to be brought about by the adjusting intervention.

* * * * *